US012012876B2

(12) United States Patent
Qian et al.

(10) Patent No.: US 12,012,876 B2
(45) Date of Patent: Jun. 18, 2024

(54) CAM PHASE ADJUSTER

(71) Applicant: Schaeffler Technologies AG & Co. KG, Herzogenaurach (DE)

(72) Inventors: Qiwei Qian, Shanghai (CN); Baoyu Jian, Wuxi (CN); Wenping Guo, Shanghai (CN)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 0 days.

(21) Appl. No.: 18/021,918

(22) PCT Filed: Aug. 20, 2020

(86) PCT No.: PCT/CN2020/110327
§ 371 (c)(1),
(2) Date: Feb. 17, 2023

(87) PCT Pub. No.: WO2022/036651
PCT Pub. Date: Feb. 24, 2022

(65) Prior Publication Data

US 2023/0349306 A1 Nov. 2, 2023

(51) Int. Cl.
*F01L 1/344* (2006.01)

(52) U.S. Cl.
CPC ... *F01L 1/3442* (2013.01); *F01L 2001/34459* (2013.01); *F01L 2001/34463* (2013.01); *F01L 2001/34466* (2013.01)

(58) Field of Classification Search
CPC ..... F01L 1/3442; F01L 2001/34453; F01L 2001/34459; F01L 2001/34463;
(Continued)

(56) References Cited

U.S. PATENT DOCUMENTS 8,342,144 B2 1/2013 Busse et al.
8,813,700 B2 8/2014 Dupuis
(Continued)

FOREIGN PATENT DOCUMENTS

CN 102367749 A 3/2012
CN 102549241 A 7/2012
(Continued)

*Primary Examiner* — Loren C Edwards

(57) ABSTRACT

The present disclosure relates to a cam phase adjuster that includes a stator, a rotor, a front cover and at least one locking pin. The cam phase adjuster is provided with a plurality of compartments formed between the rotor and the stator, and each compartment is divided into advance cavities and retard cavities in a circumferential direction; each locking pin is mounted in a corresponding mounting hole of the rotor; an end portion of each locking pin that faces away from the front cover abuts against the bottom of the corresponding mounting hole by means of a corresponding elastic reset member; an end face of the front cover that faces the rotor is provided with at least one locking groove which matches the at least one locking pin; the end portion of each locking pin that faces the front cover can be axially inserted into the corresponding locking groove; and the front cover is provided with an unlocking flow channel which fluidly connects the corresponding locking groove to one advance cavity or retard cavity.

20 Claims, 7 Drawing Sheets

(58) Field of Classification Search
CPC ... F01L 2001/34466; F01L 2001/34469; F01L 2001/34476
See application file for complete search history.

(56) References Cited

U.S. PATENT DOCUMENTS

| | | | | |
|---|---|---|---|---|
| 2002/0139332 | A1 | 10/2002 | Takenaka | |
| 2003/0084863 | A1* | 5/2003 | Golovatai-Schmidt | F01L 1/3442 123/90.15 |
| 2012/0318219 | A1 | 12/2012 | Fischer | |

FOREIGN PATENT DOCUMENTS

| | | | |
|---|---|---|---|
| CN | 103930655 | A | 7/2014 |
| CN | 104350242 | A | 2/2015 |
| CN | 106715844 | A | 5/2017 |
| CN | 103670567 | B | 6/2017 |
| CN | 107091129 | A | 8/2017 |
| CN | 108291457 | A | 7/2018 |
| CN | 208106516 | U | 11/2018 |
| CN | 110730856 | A | 1/2020 |

* cited by examiner

CAM PHASE ADJUSTER

CROSS-REFERENCE TO RELATED APPLICATIONS

This application is the U.S. National Phase of PCT Application PCT/CN2020/110327 filed on Aug. 20, 2020, the entire disclosure of which is incorporated by reference herein.

TECHNICAL FIELD

The present disclosure relates to the technical field of vehicles. In particular, the present disclosure relates to a cam phase adjuster for an engine timing system.

BACKGROUND

In internal combustion engines of modern vehicles, the phase relationship between a crankshaft and a camshaft is changed between an advance position and a retard position typically by means of a variable valve timing (VVT) system in order to adjust the valve opening/closing time and air intake/exhaust volumes of the internal combustion engines, thereby obtaining an optimized combustion efficiency. A main component of the VVT system is a cam phase adjuster. The cam phase adjuster comprises a stator and a rotor which are relatively rotatable, wherein the rotor is coaxially mounted on a radial inner side of the stator, and a plurality of hydraulic cavities are formed between the rotor and the stator. By means of an oil control valve mounted in the rotor, a hydraulic fluid may be controlled to flow into and flow out of these hydraulic cavities, thereby changing the phase relationship between the crankshaft and the camshaft in a targeted mode. When the oil control valve can supply the hydraulic fluid to the hydraulic cavities, a phase of the rotor relative to the stator may be controlled according to a supply volume of the hydraulic fluid. But in some cases, for example, when an engine is started, due to an insufficient supply of the hydraulic fluid, the rotor may be required to be locked at a certain rotation position by means of a locking mechanism.

For example, CN 103670567 B discloses a cam phase adjuster capable of locking a rotor at a plurality of different rotation positions relative to a stator. Wherein, a plurality of locking pins are mounted on a radial inner side of the stator, and a plurality of locking grooves are formed on a radial outer side of the rotor. When the locking pins are aligned with the locking grooves, the locking pins can be inserted into the locking grooves under the pushing of springs, thereby locking the rotor relative to the stator. In order to unlock the rotor by supplying engine oil into the locking grooves by means of the oil control valve, it is required to change a structure of the oil control valve. Meanwhile, since the cam phase adjuster is a rotatable component, the locking pins may move toward the radial outer side under the action of a centrifugal force, thus likely causing accidental unlocking.

SUMMARY

Therefore, the technical problem to be solved by the present disclosure is to provide a cam phase adjuster that is simple in structure and can be reliably locked.

The above-mentioned technical problem is solved by the cam phase adjuster according to the present disclosure. The cam phase adjuster comprises a stator, a rotor, a front cover and at least one locking pin, the rotor is rotatably mounted on a radial inner side of the stator, and the front cover is fixed to an axial end of the stator. The cam phase adjuster is provided with a plurality of compartments formed between the rotor and the stator, and the rotor is provided with a plurality of blades respectively extending radially into the corresponding compartments, thereby dividing each compartment into an advance cavity and a retard cavity in a circumferential direction. Each locking pin is mounted in a corresponding mounting hole of the rotor, the end portion of each locking pin that faces away from the front cover abuts against the bottom of the corresponding mounting hole by means of a corresponding elastic reset member, the end face of the front cover that faces the rotor is provided with at least one locking groove which matches the at least one locking pin, and the end portion of each locking pin that faces the front cover can be axially inserted into the corresponding locking groove. Wherein, the front cover is further provided with unlocking flow channels, and each unlocking flow channel fluidly connects the corresponding locking groove to one advance cavity or retard cavity, so that the locking pin in the corresponding lock groove can be pushed to axially move away from the front cover by a hydraulic fluid from the corresponding advance cavity or retard cavity.

According to an example embodiment of the present disclosure, the at least one locking groove may comprise a first locking groove and a second locking groove respectively extending circumferentially, the at least one locking pin may comprise a first locking pin and a second locking pin that are arranged in a spaced apart manner in the circumferential direction, and the rotor has an advance position, a retard position and an intermediate position relative to the stator; and the front cover is provided with one unlocking flow channel for each of the first locking groove and the second locking groove, the unlocking flow channel of the first locking groove is fluidly connected to one advance cavity, and the unlocking flow channel of the second locking groove is fluidly connected to one retard cavity. When the rotor is located at the retard position, the first locking pin and the second locking pin are respectively aligned with two ends of the first locking groove in the circumferential direction, and can be respectively inserted into the first locking groove; when the rotor is located at the advance position, the first locking pin and the second locking pin are respectively aligned with two ends of the second locking groove in the circumferential direction and can be respectively inserted into the second locking groove; and when the rotor is located at the intermediate position, the first locking pin is aligned with the end portion of the first locking groove close to the second locking groove in the circumferential direction and can be inserted into the first locking groove, while the second locking pin is aligned with the end portion of the second locking groove close to the first locking groove in the circumferential direction and can be inserted into the second locking groove.

According to another example embodiment of the present disclosure, the cam phase adjuster may further comprise an oil control valve mounted on a radial inner side of the rotor and a fluid reservoir capable of supplementing the advance cavities and the retard cavities of each compartment with the hydraulic fluid under a negative pressure, and the first compartment in the plurality of compartments is divided into a first advance cavity and a first retard cavity in the circumferential direction. The rotor is provided with: a first advance channel that fluidly connects the first advance cavity to the oil control valve; a second advance channel that fluidly connects the first advance cavity to the oil control valve; a first retard channel that fluidly connects the first retard cavity to the oil control valve; and a second retard channel that fluidly connects the first retard cavity to the oil control valve. The first locking pin is provided with a first advance connection channel and a first retard connection channel that are arranged in a spaced apart manner in an axial direction, and the second locking pin is provided with a second advance connection channel and a second retard connection channel that are arranged in a spaced apart manner in the axial direction. When the first locking pin is located at the position farthest from the front cover, the first advance channel and the first retard channel are fluidly connected by means of the first advance connection channel and the first retard connection channel respectively, and when the first locking pin is inserted into the first locking groove or the second locking groove, the first advance channel and the first retard channel are respectively cut off by the first locking pin; and when the second locking pin is located at the position farthest from the front cover, the second advance channel and the second retard channel are fluidly connected by means of the second advance connection channel and the second retard connection channel respectively, and when the second locking pin is inserted into the first locking groove or the second locking groove, the second advance channel and the second retard channel are respectively cut off by the second locking pin.

According to a further example embodiment of the present disclosure, when the first locking pin abuts against the front cover but is not inserted into the first locking groove or the second locking groove, the first advance channel is fluidly connected by the first advance connection channel, and the first retard channel is cut off by the first locking pin; and when the second locking pin abuts against the front cover but is not inserted into the first locking groove or the second locking groove, the second advance channel is cut off by the second locking pin, and the second retard channel is fluidly connected by the second retard connection channel. In addition, the advance cavity fluidly connected to the unlocking flow channel of the first locking groove and the retard cavity fluidly connected to the unlocking flow channel of the second locking groove are respectively located in the compartments different from the first compartment.

According to another example embodiment of the present disclosure, at least one of the first advance connection channel, the first retard connection channel, the second advance connection channel and the second retard connection channel may be an annular groove formed on an outer side face of the first locking pin or the second locking pin.

According to another example embodiment of the present disclosure, the unlocking flow channels/unlocking flow channel of the first locking groove and/or the second locking groove may be grooves/a groove formed in the end face of the front cover that faces the rotor.

BRIEF DESCRIPTION OF THE DRAWINGS

The present disclosure will be further described below in conjunction with accompanying drawings. The same reference numerals in the drawings indicate elements with the same functions. In the drawings.

DETAILED DESCRIPTION

Specific implementations of the cam phase adjuster according to the present disclosure will be described below in conjunction with accompanying drawings. The following detailed description and drawings are intended to exemplarily illustrate the principle of the present disclosure. The present disclosure is not limited to the described embodiments herein.

First Embodiment

Figure 1:
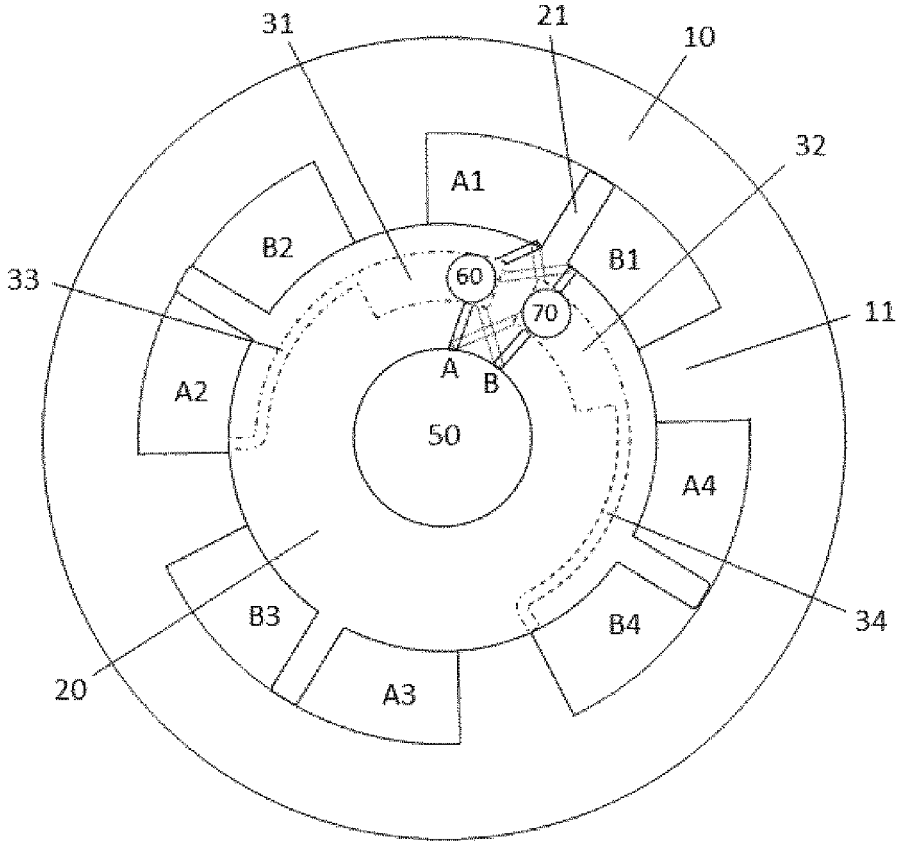
FIG. 1 shows a schematic diagram of a cam phase adjuster according to a first embodiment of the present disclosure.

The present disclosure provides a cam phase adjuster for an engine timing system of a motor vehicle. FIG. 1 shows a schematic diagram of the cam phase adjuster according to the first embodiment of the present disclosure. The cam phase adjuster comprises a stator 10, a rotor 20, a front cover 30, a rear cover 40 and an oil control valve 50. The stator 10 and the rotor 20 are each in a substantially annular shape. The rotor 20 is coaxially mounted on a radial inner side of the stator 10, and the oil control valve 50 is coaxially mounted on a radial inner side of the rotor 20. The front cover 30 and the rear cover 40 are respectively fixed to two axial ends of the stator 10 so as to close the rotor 20. The stator 10 is provided with a plurality of spacers 11 extending toward the radial inner side to abut against the rotor 20, so that a compartment is formed between every two spacers 11 which are adjacent in a circumferential direction. The rotor 20 is provided with a blade 21 extending toward a radial outer side to abut against the stator 10 in each compartment, thereby dividing each compartment into an advance cavity and a retard cavity in the circumferential direction. The advance cavity in each compartment is positioned in the same circumferential direction relative to the retard cavity, for example, in FIG. 1, the advance cavity in each compartment is located in a counterclockwise direction of the corresponding retard cavity. In the present embodiment, four compartments are schematically shown, and these compartments are respectively divided into four advance cavities A1, A2, A3, A4 and four corresponding retard cavities B1, B2, B3, B4. However, the cam phase adjuster may be provided with more or fewer compartments as desired.

Figure 2A:
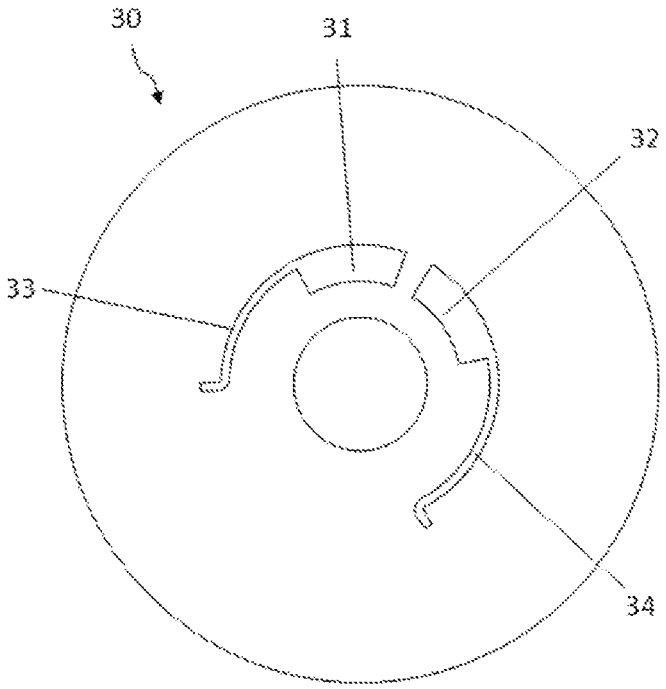
FIG. 2*a* and FIG. 2*b* show exploded views of all components of the cam phase adjuster according to the first embodiment of the present disclosure.

FIG. 2*a* shows a schematic diagram of the front cover 30 viewed from the side facing away from the rotor 20 in perspective. Two locking grooves (namely, a first locking groove 31 and a second locking groove 32) and two unlocking flow channels (namely, a first unlocking flow channel 33 and a second unlocking flow channel 34) are formed in the end face of the front cover 30 that faces the rotor 20. The first locking groove 31 and the second locking groove 32 respectively extend by a same length in the circumferential direction, are both aligned in a radial direction and are spaced apart in the circumferential direction. When the front cover 30 is assembled with the rotor 20 together, a circumferential positioning direction of the first locking groove 31 relative to the second locking groove 32 is the same as a circumferential positioning direction of the advance cavity relative to the retard cavity in the compartment. For example, in FIG. 1 and FIG. 2*a*, the first locking groove 31 is located in a counterclockwise direction of the second locking groove 32.

Preferably, the two unlocking flow channels may respectively be grooves formed in the end face of the front cover 30 that faces the rotor 20 or may also be formed into holes in the front cover 30. The first unlocking flow channel 33 fluidly connects the first locking groove 31 to the advance cavity, for example, the second advance cavity A2, in one compartment, while the second unlocking flow channel 34 fluidly connects the second locking groove 32 to the retard cavity, for example, the fourth retard cavity B4, in one compartment. An opening through which each unlocking flow channel is fluidly connected to the corresponding compartment is preferably located at the spacer 11 close to the compartment, so as to ensure that the rotor 20 can be fluidly connected to the corresponding cavities when rotated to different positions.

Figure 2B:
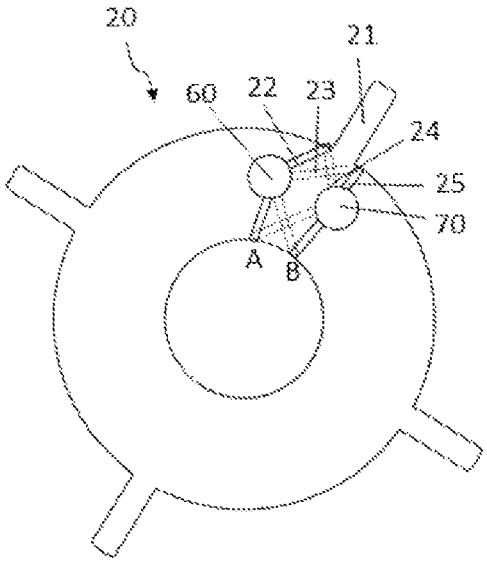

FIG. 2*b* shows a schematic diagram of the rotor 20. Two mounting holes extending axially and opened toward the front cover 30 are formed in the rotor 20, and each mounting hole is provided with a locking pin that can slide axially, that is, a first locking pin 60 and a second locking pin 70. Each locking pin is substantially cylindrical and is mounted in the corresponding mounting hole in a shape-matched manner such that each locking pin may axially slide in the corresponding mounting hole in a manner similar to a piston. The two locking pins are aligned in the radial direction and are spaced apart in the circumferential direction. The rotor 20 is further provided with four channels that fluidly connect the oil control valve 50 to the first compartment in the plurality of compartments, that is, a first advance channel 22 and a second advance channel 24 that respectively fluidly connect an advance cavity oil inlet A of the oil control valve 50 to the first advance cavity A1 of the first compartment; and a first retard channel 23 and a second retard channel 25 that respectively fluidly connect a retard cavity oil inlet B of the oil control valve 50 to the first retard cavity B1 of the first compartment. Wherein, the first advance channel 22 and the first retard channel 23 are arranged in a spaced apart manner in the axial direction, and the first locking pin 60 simultaneously passes through the first advance channel and the first retard channel; and the second advance channel 24 and the second retard channel 25 are arranged in a spaced apart manner in the axial direction, and the second locking pin 70 simultaneously passes through the second advance channel and the second retard channel. The first compartment here is a compartment different from the compartment fluidly connecting the two unlocking flow channels.

Figure 3:
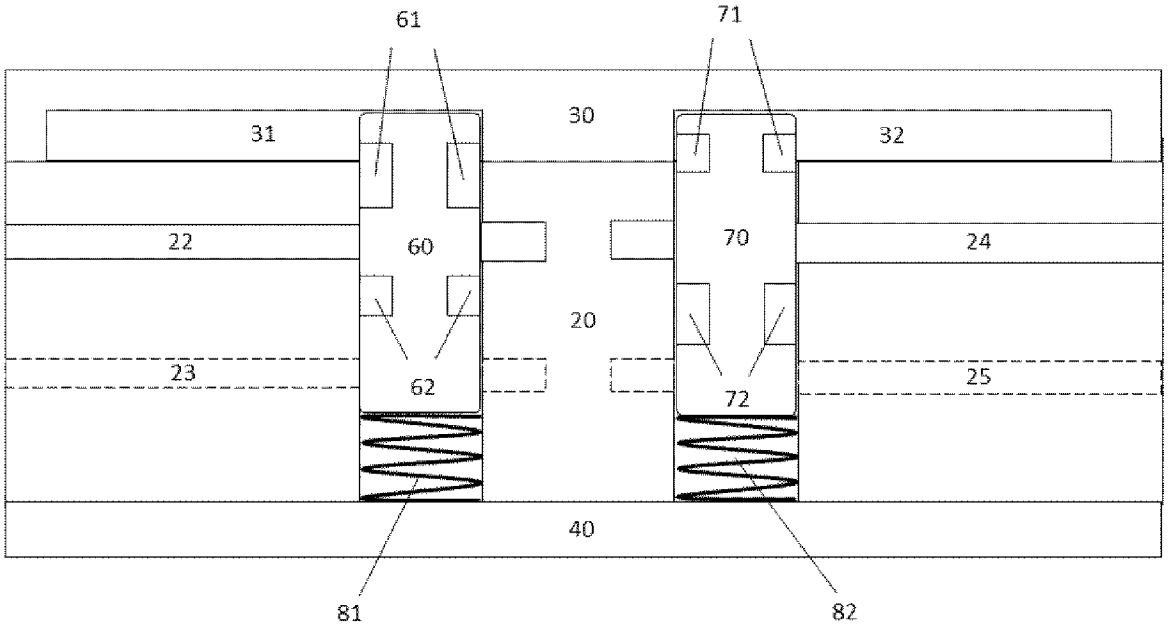
FIG. 3 shows a cross-sectional view of the cam phase adjuster according to the first embodiment of the present disclosure.

FIG. 3 shows a cross-sectional view of the cam phase adjuster. The first locking pin 60 and the second locking pin 70 are two cylindrical components having the same overall size. The two locking pins abut against the bottoms of the mounting holes facing away from the front cover 30 by means of a first elastic reset member 81 and a second elastic reset member 82 respectively. The mounting holes may be blind holes opened toward the front cover 30 or through holes penetrating the rotor 20. Therefore, the bottoms of the holes against which the two elastic reset members are abutted may be the bottoms of the blind holes of the rotor 20 or a surface of the rear cover 40. The two elastic reset members may preferably be coil springs, or may also be other elastic components. The first locking pin 60 is provided with a first advance connection channel 61 and a first retard connection channel 62 that are arranged in a spaced apart manner in the axial direction, and the second locking pin 70 is provided with a second advance connection channel 71 and a second retard connection channel 72 that are arranged in a spaced apart manner in the axial direction. These connection channels may preferably be annular grooves formed on the outer side face of the locking pin, or may also be holes in the locking pin.

The rotor 20 may rotate within a certain range relative to the stator 10. When the blades 21 of the rotor 20 abut against the spacers 11 of the stator 10 in the counterclockwise direction, a volume of each advance cavity is basically zero, a volume of each retard cavity reaches the maximum, and this position is referred to as a retard position; when the blades 21 of the rotor 20 abut against the spacers 11 of the stator 10 in a clockwise direction, the volume of each advance cavity reaches the maximum, the volume of each retard cavity is basically zero, and this position is referred to as an advance position; and when the blades 21 of the rotor 20 are located in the middles of the compartments, the volumes of the advance cavity and the retard cavity are roughly the same, and this position is referred to as an intermediate position. As shown in FIG. 1, when all components of the cam phase adjuster are assembled together, the two locking grooves in the front cover 30 are aligned with the two mounting holes/locking pins on the rotor 20 in the radial direction, so that when the rotor 20 rotates to a certain position, the two locking pins can be axially inserted into the locking grooves in the front cover 30 respectively. At the retard position, the two locking pins are respectively aligned with the two ends of the first locking groove 31 in the circumferential direction, and can be axially inserted into the first locking groove 31 respectively, thereby locking the rotor 20 at the retard position; at the advance position, the two locking pins are respectively aligned with the two ends of the second locking groove 32 in the circumferential direction, and can be axially inserted into the second locking groove 32 respectively, thereby locking the rotor 20 at the advance position; and at the intermediate position, the first locking pin 60 is aligned with the end portion of the first locking groove 31 close to the second locking groove 32 in the circumferential direction, and can be axially inserted into the first locking groove 31, while the second locking pin 70 is aligned with the end portion of the second locking groove 32 close to the first locking groove 31 in the circumferential direction, and can be inserted into the second locking groove 32, thereby locking the rotor 20 at the intermediate position.

Axial lengths of the two locking pins are smaller than depths of the mounting holes, so that when the locking pins compress the elastic reset members to reach the lower positions farthest from the front cover 30, the locking pins are completely located inside the mounting holes, and the top ends of the locking pins are separated from the lower end face of the rotor 20 by a certain distance. As shown in FIG. 3, an axial width of the first advance connection channel 61 is greater than that of the first retard connection channel 62, and an axial width of the second advance connection channel 71 is smaller than that of the second retard connection channel 72. When one locking pin is aligned with any part of any locking groove in the circumferential direction, if no hydraulic fluid is introduced into the locking groove from the corresponding unlocking flow channel, the top end of the locking pin will be inserted into the locking groove under the pushing of the corresponding elastic reset member. At this time, neither the advance channel nor the retard channel through which the locking pin passes is aligned with the corresponding connection channel in the locking pin, and both the advance channel and the retard channel are cut off by the locking pin. If hydraulic fluid has been introduced into the locking groove from the corresponding unlocking flow channel, the locking pin will be pushed down by the hydraulic fluid, thereby reaching the lower position in the mounting hole farthest from the front cover 30 by overcoming an elastic force of the elastic reset member. At this time, the advance channel is fluidly connected by the corresponding advance connection channel, and the retard channel is also fluidly connected by the corresponding retard connection channel. If one locking pin is located between two locking grooves in the circumferential direction and is not subjected to the action of the hydraulic fluid, the locking pin will axially abut against the end face of the front cover 30 that faces the rotor 20 under the action of the elastic force, so that the top end of the locking pin is substantially flush with the end face of the rotor 20. In this case, with regard to the first locking pin 60, the first advance connection channel 61 is still aligned with the first advance channel 22, but the first retard connection channel 62 is not aligned with the first retard channel 23, so that the first advance channel 22 is connected but the first retard channel 23 is cut off; and with regard to the second locking pin 70, the second retard connection channel 72 is still aligned with the second retard channel 25, but the second advance connection channel 71 is not aligned with the second advance channel 24, so that the second retard channel 25 is fluidly connected but the second advance channel 24 is cut off.

In addition, a fluid reservoir 90 is further arranged at the position of one axial end of the cam phase adjuster. The hydraulic fluid may be stored in the fluid reservoir 90. The fluid reservoir 90 is fluidly connected to each advance cavity and retard cavity respectively by means of a one-way valve, and may supplement each advance cavity and retard cavity with the hydraulic fluid under the negative pressure in each advance cavity or retard cavity. Such negative pressure is typically caused by an alternating torque transmitted to the rotor 20 from a camshaft. The working principle of such fluid reservoir 90 is known, and is disclosed, for example, in patent documents such as CN 110730856 A, CN 108291457 A and CN 102549241 A of the present applicants, and the above-mentioned patent documents are hereby incorporated into this application in their entirety, and will not be repeated here.

The process and principle of switching the cam phase adjuster between different positions will be described below with reference to FIG. 4 to FIG. 7.

Figure 4:
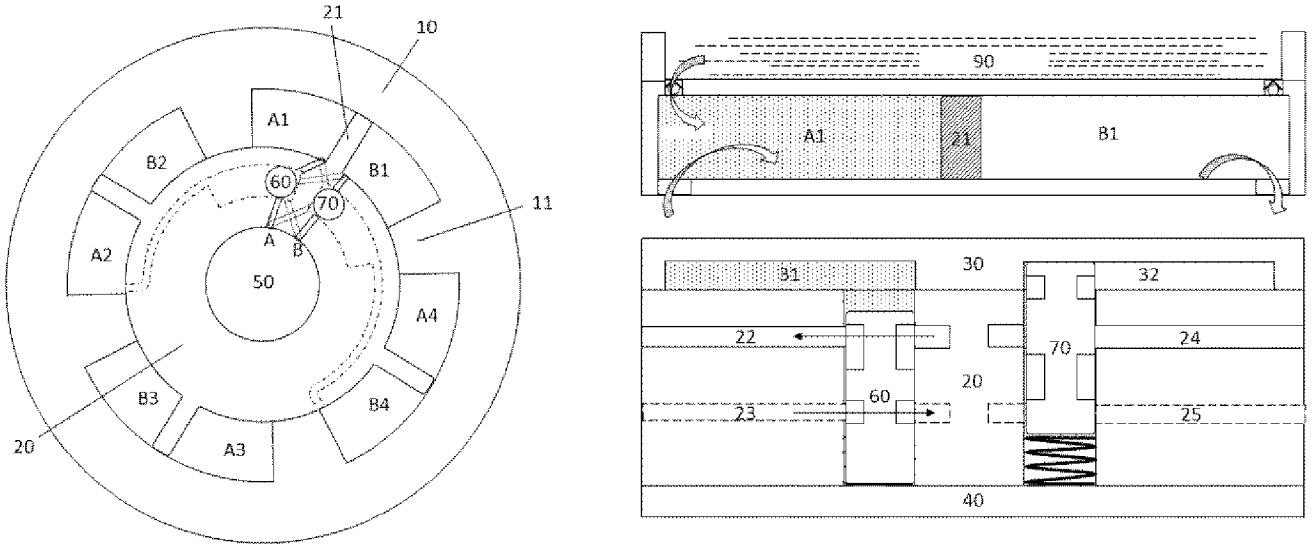
FIG. 4 to FIG. 7 show schematic diagrams of the cam phase adjuster according to the first embodiment of the present disclosure in different states.
Figure 5:
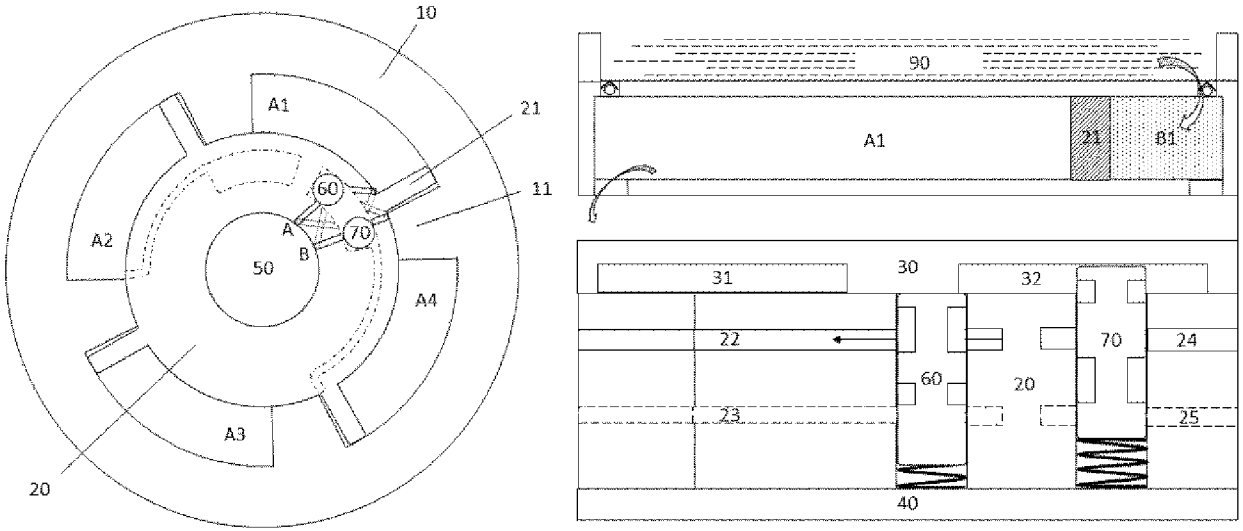

Locked Intermediate Position—Unlocked Advance Position:

As shown in FIG. 4, when the rotor 20 is locked at the intermediate position relative to the stator 10, if the rotor 20 needs to be unlocked and rotated to the advance position, the following operations may be performed. First, the first locking pin 60 is inserted into the first locking groove 31, the second locking pin 70 is inserted into the second locking groove 32, and hydraulic fluid channels leading to the first compartment are all fluidly disconnected. Then, the advance cavity inlet port A of the oil control valve 50 starts to supply the hydraulic fluid to each compartment, and the retard cavity inlet port B starts to discharge the hydraulic fluid from each compartment. At this time, the other advance cavities except the first advance cavity A1 will be filled with the hydraulic fluid, and the other retard cavities except the first retard cavity B1 will be emptied of the hydraulic fluid. The hydraulic fluid enters the first locking groove 31 from the second advance cavity A2 through the first unlocking flow channel 33, thereby pushing the first locking pin 60 to move to the lowest position by overcoming the elastic force of the first elastic reset member 81. Thus, the first advance channel 22 is fluidly connected by the first advance connection channel 61, and the first retard channel 23 is fluidly connected by the first retard connection channel 62. The rotor 20 rotates relative to the stator 10 together with the two locking pins. At this time, since the second locking pin 70 is not under a liquid pressure, thereby not being unlocked, the upper end thereof will slide in the second locking groove 32. The hydraulic fluid in each advance cavity pushes the blades 21, so that the rotor 20 is rotated to the unlocked advance position (namely, close to a locked advance position), as shown in FIG. 5. By controlling an intake volume of the hydraulic fluid through the oil control valve 50, the rotor 20 may be stabilized at any point between the advance position and the intermediate position instead of being locked to the advance position.

The process of switching the rotor 20 from the locked intermediate position to the unlocked retard position is also similar.

Unlocked Advance Position—Locked Intermediate Position:

As shown in FIG. 5, when the rotor 20 is located close to the advance position relative to the stator 10, thereby being not locked, if the rotor 20 needs to be restored to the intermediate position, the following operations may be performed. First, the first locking pin 60 axially abuts against the end face of the front cover 30 that is between the two locking grooves, the second locking pin 70 is inserted into the second locking groove 32, and only the first advance channel 22 is fluidly connected by the first advance connection channel 61, while all other channels leading to the first compartment are fluidly disconnected. The oil control valve 50 stops supplying the hydraulic fluid to any oil inlet. At this time, the hydraulic fluid in other compartments will be discharged, and the hydraulic fluid in the first advance cavity A1 in the first compartment will also be discharged through the first advance channel 22, and only two channels of the first retard cavity B1 in the first compartment that lead to the oil control valve 50 are fluidly disconnected, and thus, the hydraulic fluid will remain in the first retard cavity B1. If the rotor 20 is subjected to the alternating torque from the camshaft, a negative pressure relative to the fluid reservoir 90 will be generated in the first retard cavity B1, and thus, the fluid reservoir 90 will supplement the first retard cavity B1 with the hydraulic fluid. Under the action of the hydraulic fluid in the first retard cavity B1, the rotor 20 automatically rotates to the intermediate position. During the rotation, since no hydraulic fluid flows in from the second unlocking flow channel 34, the upper end of the second locking pin 70 always slides in the second locking groove 32. When reaching the intermediate position, the first locking pin 31 will be automatically inserted into the first locking groove 31 under the action of the elastic force of the first elastic reset member 81, while the second locking pin 70 is still inserted into the second locking groove 32. Thus, the rotor 20 is automatically locked to the intermediate position.

The process of switching the rotor 20 from the unlocked retard position to the locked intermediate position is also similar. Based on such principle, if the oil control valve 50 does not supply the hydraulic fluid, the cam phase adjuster may automatically lock the rotor 20 to the intermediate position at any unlocked position.

Figure 6:
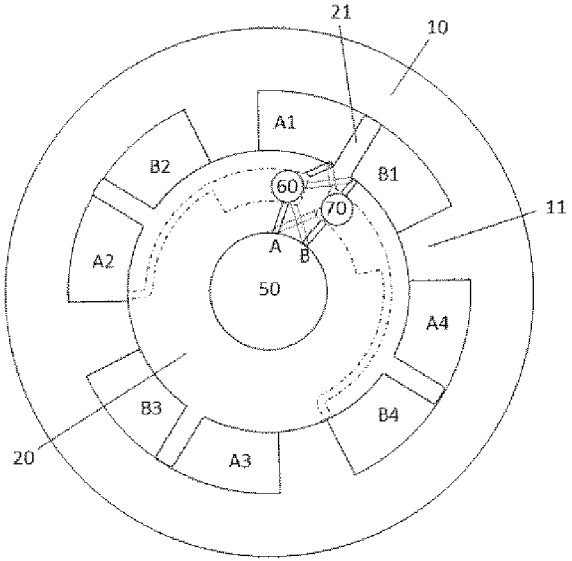
Figure 6:
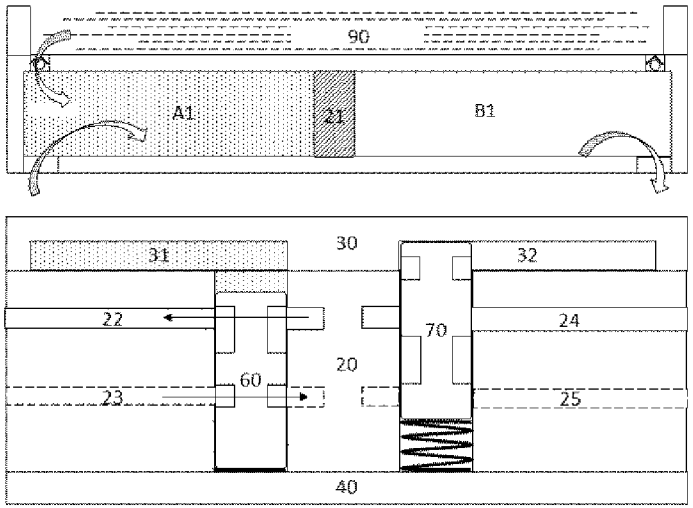

Locked Intermediate Position—Locked Advance Position:

As shown in FIG. 6, the process of switching the rotor 20 from the locked intermediate position to the locked advance position is substantially the same as the process of switching the rotor from the locked intermediate position to the unlocked advance position. The difference therebetween only lies in that the oil control valve 50 controls the rotor 20 to finally rotate to the advance position, so that the first locking pin 60 and the second locking pin 70 are respectively aligned with the two ends of the second locking groove 32. At this time, since there is no hydraulic fluid in the second locking groove 32, the first locking pin 60 will be inserted into the second locking groove 32 under the action of the elastic force of the first elastic reset member 82. Thus, the first locking pin 60 and the second locking pin 70 are respectively inserted into the two ends of the second locking groove 32, thereby locking the rotor 20 at the advance position.

The process of switching the rotor 20 from the locked intermediate position to the locked retard position is also similar.

Figure 7:
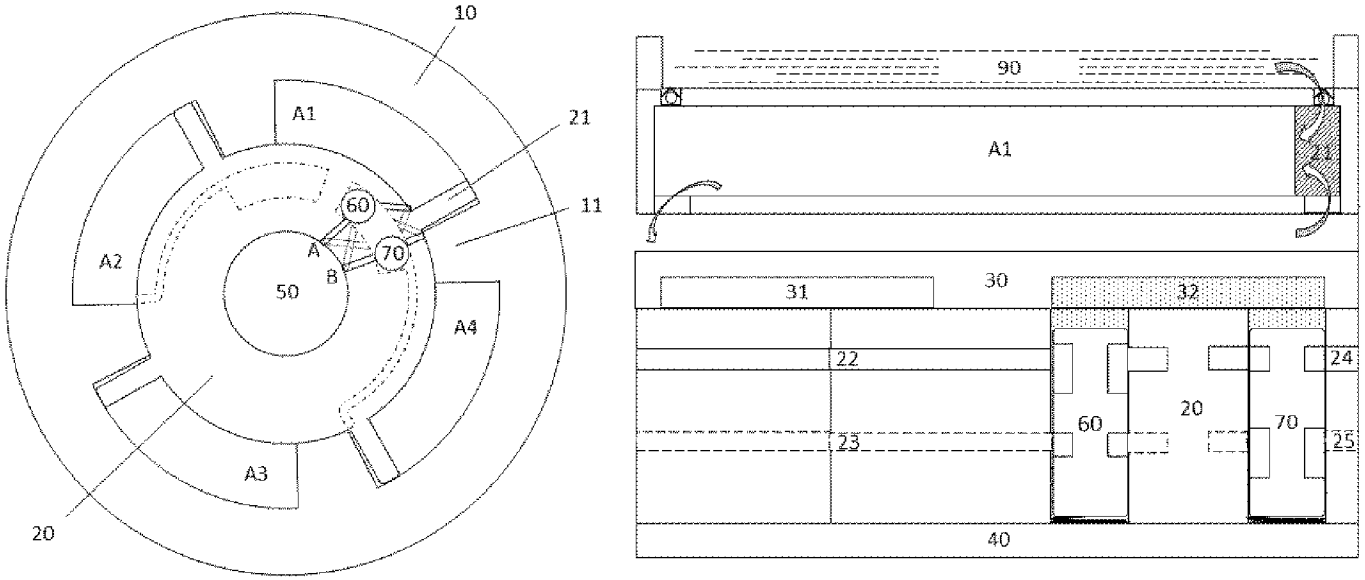

Locked Advance Position—Locked Retard Position:

As shown in FIG. 7, when the rotor 20 is locked at the advance position relative to the stator 10, if the rotor 20 needs to be unlocked and rotated to the locked retard position, the following operations may be performed. First, the two locking pins are respectively inserted into the two ends of the second locking groove 32, and the hydraulic fluid channels leading to the first compartment are all fluidly disconnected. Then, the retard cavity oil inlet B of the oil control valve 50 starts to supply the hydraulic fluid to each compartment, and the advance cavity oil supply hole A starts to discharge the hydraulic fluid from each compartment. At this time, the other retard cavities except the first retard cavity B1 will be filled with the hydraulic fluid, while the other advance cavities except the first advance cavity A1 will be emptied of the hydraulic fluid. The hydraulic fluid enters the second locking groove 32 from the fourth retard cavity B4 through the second unlocking flow channel 34, thereby pushing the two locking pins to move to the lower position farthest away from the front cover 30 by overcoming the elastic forces of the corresponding elastic reset members. Thus, two advance channels and two retard channels are all fluidly connected. Then, the rotor 20 rotates relative to the stator 10 together with the two locking pins. The hydraulic fluid in each retard cavity pushes the blades 21 so that the rotor 20 is finally rotated to the retard position. At the retard position, the first locking pin 60 and the second locking pin 70 are respectively aligned with the two ends of the first locking groove 31. At this time, since there is no hydraulic fluid in the first locking groove 31, the two locking pins will be respectively inserted into the two ends of the first locking groove 31 under the action of the elastic forces of the corresponding elastic reset members. Finally, the rotor 20 is locked at the retard position relative to the stator 10.

The process of switching the rotor 20 from the locked retard position to the locked advance position is also similar.

The cam phase adjuster according to the embodiments of the present disclosure achieves the complex function of locking the rotor relative to the stator by means of a simple channel structure without changing the structure of the oil control valve, thereby being low in cost and reliable in effect.

Other Embodiments

In addition, according to other embodiments of the present disclosure, various changes may also be made to the cam phase adjuster in the first embodiment. For example, in one alternative embodiment, the hydraulic fluid channels leading to the compartments are not be controlled by the locking pins. At the time, the forms of the advance channel and the retard channel leading to the first compartment may also be the same as those of the channels leading to other compartments. In this case, the rotor cannot achieve the function of automatic locking from the unlocked position to the intermediate position. In another alternative embodiment, the cam phase adjuster may only comprise one or more locking grooves in the form of holes. In this case, since the unlocking flow channel of one locking pin can only unlock the locking pin in a single direction of rotation, such locking grooves are generally used only to lock the rotor at the retard position or advance position relative to the stator, and are not used to lock the rotor at the intermediate position relative to the stator.

Although possible embodiments have been described illustratively in the above description, it should be understood that there are still a large number of embodiment variations through combinations of all known technical features and embodiments as well as those are readily apparent to those skilled in the art. In addition, it should be further understood that the exemplary embodiments are just examples and shall not in any way limit the scope of protection, application or construction of the present disclosure. The foregoing description is more intended to provide those skilled in the art with a technical guide for converting at least one exemplary embodiment, in which various changes, especially changes in the functions and structures of the components, can be made as long as they do not depart from the scope of protection of the claims.

LIST OF REFERENCE NUMERALS

10 Stator
11 Spacer
20 Rotor
21 Blade
22 First advance channel
23 First retard channel
24 Second advance channel
25 Second retard channel
30 Front cover
31 First locking groove
32 Second locking groove
33 First unlocking flow channel
34 Second unlocking flow channel
40 Rear cover
50 Oil control valve
60 First locking pin
61 First advance connection channel
62 First retard connection channel
70 Second locking pin
71 Second advance connection channel
72 Second retard connection channel
81 First elastic reset member
82 Second elastic reset member
90 Fluid reservoir
A Advance cavity oil inlet
B Retard cavity oil inlet
A1 First advance cavity
A2 Second advance cavity
A3 Third advance cavity
A4 Fourth advance cavity
B1 First retard cavity
B2 Second retard cavity
B3 Third retard cavity
B4 Fourth retard cavity

The invention claimed is:

1. A cam phase adjuster, comprising:

a stator, a rotor rotatably mounted on a radial inner side of the stator, a front cover fixed to an axial end of the stator, and at least one locking pin, a plurality of compartments formed between the rotor and the stator, the rotor being provided with a plurality of blades respectively extending radially into the plurality of compartments, thereby dividing each of the plurality of compartments into an advance cavity and a retard cavity in a circumferential direction, and the at least one locking pin mounted in a corresponding mounting hole of the rotor, an end portion of the at least one locking pin facing away from the front cover abutting against a bottom of the corresponding mounting hole by a corresponding elastic reset member, and an end face of the front cover facing the rotor having at least one locking groove configured to receive the at least one locking pin, and an end portion of each one of the at least one locking pin facing the front cover configured to be axially inserted into at least one of the at least one locking groove, wherein, the front cover includes unlocking flow channels that fluidly connect the at least one locking groove to one advance cavity and one retard cavity, so that the at least one locking pin can be pushed to axially move away from the front cover by a hydraulic fluid from the one advance cavity and the one retard cavity.

2. The cam phase adjuster according to claim 1, wherein, the at least one locking groove comprises a first locking groove and a second locking groove that respectively extend in the circumferential direction, and the at least one locking pin comprises a first locking pin and a second locking pin circumferentially spaced apart from the first locking pin, and the rotor has an advance position, a retard position, and an intermediate position relative to the stator, and an unlocking flow channel of the first locking groove is fluidly connected to one advance cavity, and an unlocking flow channel of the second locking groove is fluidly connected to one retard cavity, and when the rotor is located at the retard position, the first locking pin and the second locking pin: i) are respectively aligned with two ends of the first locking groove in the circumferential direction, and ii) can be respectively inserted into the first locking groove, and when the rotor is located at the advance position, the first locking pin and the second locking pin: i) are respectively aligned with two ends of the second locking groove in the circumferential direction, and ii) can be respectively inserted into the second locking groove, and when the rotor is located at the intermediate position, the first locking pin: i) is aligned with an end portion of the first locking groove proximate to the second locking groove in the circumferential direction, and ii) can be inserted into the first locking groove, while the second locking pin: i) is aligned with an end portion of the second locking groove proximate to the first locking groove in the circumferential direction, and ii) can be inserted into the second locking groove.

3. The cam phase adjuster according to claim 2, wherein, the cam phase adjuster further comprises an oil control valve mounted on a radial inner side of the rotor and a fluid reservoir configured to supplement the advance cavity and the retard cavity of each of the plurality of compartments with hydraulic fluid under a negative pressure, and a first compartment in the plurality of compartments is divided into a first advance cavity and a first retard cavity in the circumferential direction, and the rotor further comprises:

a first advance channel configured to fluidly connect the first advance cavity to the oil control valve, a second advance channel configured to fluidly connect the first advance cavity to the oil control valve, a first retard channel configured to fluidly connect the first retard cavity to the oil control valve, and a second retard channel configured to fluidly connect the first retard cavity to the oil control valve, and the first locking pin includes a first advance connection channel and a first retard connection channel axially spaced from the first advance connection channel, and the second locking pin is provided with a second advance connection channel and a second retard connection channel axially spaced from the second advance connection channel, and when the first locking pin is located at a position farthest from the front cover, the first advance channel and the first retard channel are respectively fluidly connected by the first advance connection channel and the first retard connection channel, and when the first locking pin is inserted into the first locking groove or the second locking groove, the first advance channel and the first retard channel are respectively cut off by the first locking pin, and when the second locking pin is located at the position farthest from the front cover, the second advance channel and the second retard channel are respectively fluidly connected by the second advance connection channel and the second retard connection channel, and when the second locking pin is inserted into the first locking groove or the second locking groove, the second advance channel and the second retard channel are respectively cut off by the second locking pin.

4. The cam phase adjuster according to claim 3, wherein, when the first locking pin abuts against the front cover and is not inserted into the first locking groove or the second locking groove, the first advance channel is fluidly connected by the first advance connection channel, and the first retard channel is cut off by the first locking pin, when the second locking pin abuts against the front cover and is not inserted into the first locking groove or the second locking groove, the second advance channel is cut off by the second locking pin, and the second retard channel is fluidly connected by the second retard connection channel, and an advance cavity fluidly connected to a first one of the unlocking flow channels of the first locking groove and a retard cavity fluidly connected to a second one of the unlocking flow channels of the second locking groove are respectively located in compartments different from the first compartment.

5. The cam phase adjuster according to claim 4, wherein, at least one of the first one of the unlocking flow channels or the second one of the unlocking flow channels are grooves formed in an end face of the front cover facing the rotor.

6. The cam phase adjuster according to claim 3, wherein, at least one of the first advance connection channel, the first retard connection channel, the second advance connection channel, or the second retard connection channel is an annular groove formed on an outer side face of the first locking pin or the second locking pin.

7. The cam phase adjuster according to claim 1, wherein the at least one locking pin comprises a first locking pin and a second locking pin.

8. The cam phase adjuster according to claim 7, wherein the at least one locking groove comprises a first locking groove and a second locking groove separate from the first locking groove.

9. The cam phase adjuster according to claim 8, further comprising:

a first circumferentially extending unlocking flow channel fluidly connected to the first locking groove; and a second circumferentially extending unlocking flow channel fluidly connected to the first locking groove.

10. The cam phase adjuster according to claim 8, wherein the first locking groove is configured to receive the first locking pin, and the second locking groove is configured to receive the first locking pin and the second locking pin.

11. A cam phase adjuster, comprising:

a stator, a rotor rotatably mounted within the stator, the rotor forming a plurality of circumferentially spaced compartments with the stator, and each compartment of the plurality of circumferentially spaced compartments divided into an advance cavity and a retard cavity via a radially extending blade of the rotor, a front cover fixed to an axial end of the stator, and a first locking pin and a second locking pin disposed within a respective first mounting hole and a respective second mounting hole of the rotor, the first locking pin and the second locking pin configured to be axially displaced to lock the rotor to the stator, and an end face of the front cover facing the rotor having:

a first locking groove configured to:

receive at least one of the first locking pin or the second locking pin, and fluidly connect to a first advance cavity of a first compartment of the plurality of circumferentially space compartments, and a second locking groove separate and circumferentially spaced from the first locking groove, the second locking groove configured to:

receive at least one of the first locking pin or the second locking pin, and fluidly connect to a first retard cavity of the first compartment, and in a first locked position of the rotor, the first locking pin is aligned and inserted into a first end of the first locking groove and the second locking pin is aligned and inserted into a second end of the first locking groove so that the rotor is locked in a retard position, and in a second locked position of the rotor, the first locking pin is aligned and inserted into the second end of the first locking groove and the second locking pin is aligned and inserted into a first end of the second locking groove so that the rotor is locked in an intermediate position, and in a third locked position of the rotor, the first locking pin is aligned and inserted into the first end of the second locking groove and the second locking pin is aligned and inserted into a second end of the second locking groove so that the rotor is locked in an advance position.

12. The cam phase adjuster according to claim 11, further comprising:

a first unlocking flow channel configured to fluidly connect the first locking groove to a second compartment separate and circumferentially spaced from the first compartment, and a second unlocking flow channel configured to fluidly connect the second locking groove to a third compartment separate and circumferentially spaced from the first compartment.

13. The cam phase adjuster according to claim 12, wherein the first unlocking flow channel and the second unlocking flow channel extend circumferentially on the end face of the front cover.

14. The cam phase adjuster according to claim 11, wherein:

the first locking groove is configured to fluidly connect the first compartment to a second compartment, and the second locking groove is configured to fluidly connect the first compartment to a third compartment.

15. The cam phase adjuster according to claim 11, wherein the first locking pin and the second locking pin are each fluidly connected to each one of the first retard cavity and the first advance cavity.

16. The cam phase adjuster according to claim 15, wherein each of the first locking pin and the second locking pin have an advance connection channel and a retard connection channel axially spaced apart from the advance connection channel.

17. A cam phase adjuster, comprising:

a stator, a rotor rotatably mounted within the stator, the rotor forming a plurality of circumferentially spaced compartments with the stator, and each compartment of the plurality of circumferentially spaced compartments divided into an advance cavity and a retard cavity via a radially extending blade of the rotor, a front cover fixed to an axial end of the stator, and a first locking pin and a second locking pin disposed within a respective first mounting hole and a respective second mounting hole of the rotor, the first locking pin and the second locking pin configured to be axially displaced to lock the rotor to the stator, and an end face of the front cover facing the rotor having:

a first locking groove configured to:

receive at least one of the first locking pin or the second locking pin, fluidly connect to a first advance cavity of a first compartment of the plurality of circumferentially spaced compartment via displacement of the first locking pin, and fluidly connect to a second compartment separate and circumferentially spaced from the first compartment, and a second locking groove separate and circumferentially spaced apart from the first locking groove, the second locking groove configured to:

receive at least one of the first locking pin or the second locking pin, fluidly connect to a first retard cavity of the first compartment via displacement of the second locking pin, and fluidly connect to a third compartment separate and circumferentially spaced from the first compartment, and in a first locked position of the rotor, the first locking pin is inserted into the first locking groove and the second locking pin is inserted into the first locking groove so that the rotor is locked in a retard position, and in a second locked position of the rotor, the first locking pin is inserted into the first locking groove and the second locking pin is inserted into the second locking groove so that the rotor is locked in an intermediate position, and in a third locked position of the rotor, the first locking pin is inserted into the second locking groove and the second locking pin is inserted into the second locking groove so that the rotor is locked in an advance position.

18. The cam phase adjuster according to claim 17, wherein:

the first locking pin is configured to be unlocked from the front cover via liquid pressure fluidly communicated from the second compartment, and the second locking pin is configured to be unlocked from the front cover via liquid pressure fluidly communicated from the third compartment.

19. The cam phase adjuster according to claim 18, wherein:

the first locking pin is configured to be unlocked from the front cover via liquid pressure fluidly communicated from a second advance cavity of the second compartment, and the second locking pin is configured to be unlocked from the front cover via liquid pressure fluidly communicated from a third retard cavity of the third compartment.

20. The cam phase adjuster according to claim 17, wherein each of the first locking pin and the second locking pin have an advance connection channel and a retard connection channel axially spaced apart from the advance connection channel.

* * * * *